US011649515B2

(12) United States Patent
Kang et al.

(10) Patent No.: US 11,649,515 B2
(45) **Date of Patent: *May 16, 2023**

(54) THICK STEEL PLATE HAVING EXCELLENT CRYOGENIC IMPACT TOUGHNESS AND MANUFACTURING METHOD THEREFOR

(71) Applicant: POSCO, Pohang-si (KR)

(72) Inventors: Mo-Chang Kang, Seoul (KR); Jong-In Choi, Seoul (KR)

(73) Assignee: POSCO CO., LTD, Pohang-si (KR)

( * ) Notice: Subject to any disclaimer, the term of this patent is extended or adjusted under 35 U.S.C. 154(b) by 297 days.

This patent is subject to a terminal disclaimer.

(21) Appl. No.: 16/472,246

(22) PCT Filed: Dec. 20, 2017

(86) PCT No.: PCT/KR2017/015134

§ 371 (c)(1),
(2) Date: Jun. 21, 2019

(87) PCT Pub. No.: WO2018/117646

PCT Pub. Date: Jun. 28, 2018

(65) Prior Publication Data

US 2019/0316219 A1 Oct. 17, 2019

(30) Foreign Application Priority Data

Dec. 22, 2016 (KR) ..... 10-2016-0176513

(51) Int. Cl.

| | |
|---|---|
| ***C21D 8/02*** | (2006.01) |
| ***C21D 6/00*** | (2006.01) |
| ***C22C 38/58*** | (2006.01) |
| ***C22C 38/50*** | (2006.01) |
| ***C22C 38/46*** | (2006.01) |
| ***C22C 38/48*** | (2006.01) |
| ***C22C 38/02*** | (2006.01) |
| ***C22C 38/00*** | (2006.01) |

(52) U.S. Cl.

CPC ..... *C21D 8/0226* (2013.01); *C21D 6/004* (2013.01); *C21D 6/005* (2013.01); *C21D 6/008* (2013.01); *C21D 8/0205* (2013.01); *C22C 38/002* (2013.01); *C22C 38/02* (2013.01); *C22C 38/46* (2013.01); *C22C 38/48* (2013.01); *C22C 38/50* (2013.01); *C22C 38/58* (2013.01); *C21D 2211/005* (2013.01); *C21D 2211/009* (2013.01)

(58) Field of Classification Search

CPC ..... C21D 8/0226; C21D 6/004; C21D 6/005; C21D 6/008; C21D 8/0205; C21D 2211/005; C21D 2211/009; C22C 38/002; C22C 38/02; C22C 38/46; C22C 38/48; C22C 38/50; C22C 38/58

See application file for complete search history.

(56) References Cited

U.S. PATENT DOCUMENTS

| | | | | |
|---|---|---|---|---|
| 4,072,543 | A | 2/1978 | Coldren et al. | |
| 4,397,698 | A | 8/1983 | Davenport et al. | |
| 2006/0151074 | A1 | 7/2006 | Ishikawa et al. | |
| 2012/0031532 | A1* | 2/2012 | Ishikawa | C22C 38/04 148/541 |
| 2013/0244056 | A1 | 9/2013 | Kawamura et al. | |
| 2014/0178712 | A1 | 6/2014 | Maruyama et al. | |
| 2018/0073115 | A1* | 3/2018 | Hayashida | C22C 38/44 |

FOREIGN PATENT DOCUMENTS

| | | | |
|---|---|---|---|
| CN | 102119236 | A | 7/2011 |
| CN | 102605296 | A | 7/2012 |
| CN | 102959116 | A | 3/2013 |
| CN | 105102659 | A | 11/2015 |
| CN | 105671439 | A | 6/2016 |
| EP | 2397570 | A1 | 12/2011 |
| EP | 2520680 | A2 | 11/2012 |
| EP | 2955242 | A1 | 12/2015 |
| EP | 2743364 | B1 | 7/2016 |
| JP | H09-095731 | A | 4/1997 |
| JP | 2002-220622 | A | 8/2002 |
| JP | 2004-232091 | A | 8/2004 |
| JP | 2011-074495 | A | 4/2011 |
| JP | 2012-012624 | A | 1/2012 |
| JP | 2014-201764 | A | 10/2014 |
| KR | 2001-0062884 | A | 7/2001 |
| KR | 10-0435465 | B1 | 6/2004 |
| KR | 10-2009-0069871 | A | 7/2009 |
| KR | 20090069871 | A * | 7/2009 |
| KR | 10-2011-0060449 | A | 6/2011 |

(Continued)

OTHER PUBLICATIONS

Chinese Office Action dated Jul. 24, 2020 issued in Chinese Patent Application No. 201780079143.8 (with English translation).

Japanese Office Action dated Sep. 1, 2020 issued in Japanese Patent Application No. 2019-532809.

International Search Report dated Apr. 4, 2018 issued in International Patent Application No. PCT/KR2017/015134 (with English translation).

Extended European Search Report dated Aug. 27, 2019 issued in European Patent Application No. 17883359.6.

*Primary Examiner* — Anthony M Liang

(74) *Attorney, Agent, or Firm* — Morgan, Lewis & Bockius LLP

(57) ABSTRACT

The purpose of one aspect of the present invention is to provide: a thick steel plate capable of removing a conventional normalizing treatment required for ensuring toughness low temperature and cryogenic environments, and having properties equal to or better than those of a conventional steel subjected to the normalizing treatment; and a method for manufacturing the method.

8 Claims, No Drawings

(56) References Cited

FOREIGN PATENT DOCUMENTS

| | | | | |
|---|---|---|---|---|
| KR | 20110060449 | A | * | 6/2011 |
| KR | 10-2012-0074638 | A | | 7/2012 |
| KR | 20120074638 | A | * | 7/2012 |
| KR | 10-2013-0021407 | A | | 3/2013 |
| KR | 10-2014-0098901 | A | | 8/2014 |
| KR | 10-2016-0068048 | A | | 6/2016 |
| KR | 20160068048 | A | * | 6/2016 |
| KR | 10-2016-0077385 | A | | 7/2016 |
| KR | 10-2016-0077392 | A | | 7/2016 |
| NL | 7711438 | A | | 7/1978 |
| WO | 2004/111286 | A1 | | 12/2004 |
| WO | 2011/052095 | A1 | | 5/2011 |
| WO | 2013/022043 | A1 | | 2/2013 |
| WO | 2016/171212 | A1 | | 10/2016 |

* cited by examiner

THICK STEEL PLATE HAVING EXCELLENT CRYOGENIC IMPACT TOUGHNESS AND MANUFACTURING METHOD THEREFOR

CROSS-REFERENCE OF RELATED APPLICATIONS

This application is the U.S. National Phase under 35 U.S.C. § 371 of International Patent Application No. PCT/KR2017/015134, filed on Dec. 20, 2017, which in turn claims the benefit of Korean Application No. 10-2016-0176513, filed on Dec. 22, 2016, the entire disclosures of which applications are incorporated by reference herein.

TECHNICAL FIELD

The present disclosure relates to a thick steel plate having excellent cryogenic impact toughness, capable of being suitably used in an environment of 0 to −60° C., and a method of manufacturing the same.

BACKGROUND ART

To secure properties such as low temperature toughness in a thick steel plate, internal homogenization is required. To this end, a normalizing heat treatment is performed on a steel material produced by general hot-rolling (a hot-rolled steel plate), using an offline heat treatment facility.

However, in performing the normalizing heat treatment as described above, there is a disadvantage in that the cost increases and production days increase, due to reheating of steel plates for normalizing performance along with an additional process to a manufacturing process.

Thus, a material of online normalizing called "Normalizing Rolling" has been developed and commercialized, in which rolling is terminated in a normalizing temperature region. However, there is a difficulty in securing the quality such as an equal level of properties, for example, impact toughness or the like, when compared with the case of an offline heat treatment material.

Therefore, there is a need for a technique capable of providing a thick steel plate having properties equal to or higher than that of an existing offline heat treatment material even when the normalizing rolling method is used.

(Patent Document 1) Korean Patent Laid-Open Publication No. 2014-0098901

DISCLOSURE

Technical Problem

An aspect of the present disclosure is to provide a thick steel plate having properties equal to or higher than those of an existing steel material, having been subjected to a normalizing treatment, while omitting the normalizing treatment required for securing toughness at low temperature and cryogenic temperature environment in the related art, and to provide a method of manufacturing the same.

Technical Solution

According to an aspect of the present disclosure, a thick steel plate having excellent cryogenic impact toughness includes, by weight %, 0.02% to 0.10 of carbon (C), 0.6 to 1.7% of manganese (Mn), 0.5% or less (excluding 0%) of silicon (Si), 0.02% or less of phosphorus (P), 0.015% or less of sulfur (S), 0.005 to 0.05% of niobium (Nb), 0.005 to 0.07% of vanadium (V), and a remainder of iron (Fe), and other unavoidable impurities. The thick steel plate has, by area fraction, a mixed structure of ferrite of 85 to 95% and pearlite of 5 to 15%, as a microstructure.

According to an another aspect of the present disclosure, a method of manufacturing a thick steel plate having excellent cryogenic impact toughness comprises reheating a steel slab satisfying the above-described alloy composition at a temperature of 1100° C. or higher; finishing hot-rolling the reheated steel slab at a temperature of 850 to 910° C. to produce a hot-rolled steel plate; and air-cooling the hot-rolled steel plate to a room temperature after the finishing hot-rolling.

Advantageous Effects

According to an embodiment in the present disclosure, a thick steel plate in which impact toughness may be stably secured from 0° C. to −60° C. may be provided.

As described above, a thick steel plate having high efficiency even without performing a normalizing heat treatment may be provided, which is advantageous in terms of economical effects.

BEST MODE FOR INVENTION

In the related art, a separate normalizing heat treatment on the hot rolled steel plate is performed to secure the low temperature impact toughness and the like of the existing thick steel plate. However, the inventors of the present disclosure conducted depth studies to provide a thick steel plate having properties equal to or greater than that of a thick steel plate manufactured by the existing method, even without using such a heat treatment facility.

As a result, it has been confirmed that a thick steel plate having required properties may be produced even when the normalizing heat treatment is omitted, as the alloy composition and the manufacturing conditions are optimized.

In detail, the present disclosure is technically meaningful in that it does not require a separate normalizing heat treatment by controlling the rolling temperature.

Hereinafter, an embodiment of the present disclosure will be described in detail.

A thick steel plate having excellent cryogenic impact toughness according to an embodiment in the present disclosure comprises, by weight %, 0.02 to 0.10% of carbon (C), 0.6 to 1.7% of manganese (Mn), 0.5% or less of silicon (Si), 0.02% or less of phosphorus (P), 0.015% or less of sulfur (S), 0.005 to 0.05% of niobium (Nb), and 0.005 to 0.07% of vanadium (V).

Hereinafter, the reason that the alloy composition of a thick steel plate provided in the present disclosure is controlled as described above will be described in detail. In this case, the content of each element refers to weight % unless otherwise specified.

C: 0.02 to 0.10%

Carbon (C) is an essential element which improves the strength of steel. However, if the content of C is excessive, the rolling load during rolling is increased due to high temperature strength, and instability of toughness at a cryogenic temperature of −20° C. or lower is caused.

On the other hand, if the content of C is less than 0.02%, it is difficult to secure the strength required in the present disclosure, and in order to control the content to be less than 0.02%, a decarburization process is further required, which may cause an increase in costs. On the other hand, if the content thereof exceeds 0.10%, the rolling load may be increased, and it may be difficult to secure cryogenic toughness.

Therefore, according to an embodiment in the present disclosure, the content of C may be controlled to be within a range of 0.02 to 0.10%. In more detail, the content of C may be controlled to be within 0.05 to 0.10%.

Mn: 0.6 to 1.7%

Manganese (Mn) is an essential element for securing the impact toughness of steel and controlling impurity elements such as S and the like, but when Mn is added in excess with C, there is a possibility that weldability may be decreased.

According to an embodiment in the present disclosure, as described above, the toughness of steel may be effectively secured by controlling the content of C, and to obtain high strength, the strength may be improved with Mn without adding the C, and thus, impact toughness may be maintained.

To obtain the above-mentioned effect, Mn may be contained in an amount of 0.6% or more. However, if the content is too high and exceeds 1.7%, the weldability decreases according to the excess of the carbon equivalent, and local toughness in the thick steel plate may decrease and cracks may occur due to segregation during casting.

Therefore, according to an embodiment in the present disclosure, the Mn content may be controlled to be within a range of 0.6 to 1.7%.

Si: 0.5% or Less (Excluding 0%)

Silicon (Si) is a major element for deoxidizing steel, and is an element favorable for securing strength of steel by solid solution strengthening.

However, if the content of Si exceeds 0.5%, there may be a problem in which the load will be increased during rolling and the toughness of a base material (thick-steel plate itself) and a welded portion obtained at the time of welding deteriorates.

Therefore, according to an embodiment in the present disclosure, the content of Si is controlled to be 0.5% or less while excluding 0%.

P: 0.02% or Less

Phosphorus (P) is an element which is inevitably contained during the production of steel, and is an element which is liable to segregation and easily forms a low-temperature transformation microstructure and thus has a large influence on toughness degradation.

Therefore, the content of P may be controlled to be as low as possible. According to an embodiment in the present disclosure, the content of P may be controlled to be 0.02% or less, because there is no great difficulty in securing the properties even when P is contained in an amount of 0.02% at most.

S: 0.015% or Less

Sulfur (S) is an element that is inevitably contained during the production of steel. When the content of S is excessive, there is a problem of increasing non-metallic inclusions and deteriorating toughness.

Therefore, the content of S may be controlled to be as low as possible. According to an embodiment in the present disclosure, the content of S may be controlled to be 0.015% or less since there is no great difficulty in securing the properties even when S is contained at a maximum of 0.015%.

Nb: 0.005 to 0.05%

Niobium (Nb) is an element favorable for forming a fine microstructure, and is advantageous for securing strength and ensuring impact toughness. In detail, according to an embodiment in the present disclosure, addition of Nb is required to stably obtain homogenization of the microstructure and a fine microstructure during normalizing rolling.

The content of Nb is determined by the amount of Nb dissolved by the temperature and time in reheating process of slab for rolling, but the content thereof exceeding 0.05% is not preferable because the content exceeds the melting range. On the other hand, if the content of Nb is less than 0.005%, the precipitation amount is insufficient and the above-mentioned effect may not be sufficiently obtained, which is not preferable.

Therefore, according to an embodiment in the present disclosure, the content of Nb may be controlled to be within a range of 0.005 to 0.05%.

V: 0.005 to 0.07%

Vanadium (V) is an element favorable for securing strength of steel. In detail, according to an embodiment in the present disclosure, since the content of C is limited to secure the impact toughness of steel and the content of Mn is limited to control an influence of segregation, insufficient strength of steel due to the limitation of C and Mn may be secured through addition of V. Further, the above-mentioned effect of V is exhibited in a low temperature region, and thus, there is an effect of reducing rolling load.

On the other hand, if the content of V is more than 0.07%, embrittlement may be affected due to a precipitate. If the content of V is lower than 0.005%, the precipitation amount may be insufficient and the above-mentioned effect may not be sufficiently obtained.

Therefore, according to an embodiment in the present disclosure, the V content may be controlled to be within 0.005 to 0.07%.

On the other hand, according to an embodiment in the present disclosure, to further improve properties of a thick steel plate satisfying the above-mentioned alloy composition, one or more of nickel (Ni) and chromium (Cr) may further be contained in an amount of 0.5% or less, respectively, and Ti may further be contained in an amount of 0.005 to 0.035%.

Nickel (Ni) and chromium (Cr) may be added to secure the strength of steel, and may be added in an amount of 0.5% or less in consideration of the limitation of the essential elements and a carbon equivalent.

Titanium (Ti) combines with nitrogen to forma precipitate, thereby controlling excessive formation of precipitates by Nb and V, and in detail, suppressing deterioration of surface quality that may occur during the production of a continuously cast slab.

To obtain the above-mentioned effect, Ti may be added in an amount of 0.005% or more, but if the content thereof is excessively more than 0.035%, the precipitates are excessively formed on grain boundaries, which may deteriorate steel properties.

The remainder element in the embodiment of the present disclosure is iron (Fe). On the other hand, in an ordinary manufacturing process, impurities which are not intended may inevitably be incorporated from a raw material or a surrounding environment, which may not be excluded. These impurities are known to any person skilled in the manufacturing field, and thus, are not specifically mentioned in this specification.

The thick steel plate according to an embodiment in the present disclosure satisfying the above-described alloy composition may include a ferrite and pearlite mixed structure as a microstructure thereof.

In more detail, according to an embodiment, 85 to 95% of ferrite and 5 to 15% of pearlite are included in an area fraction, thereby obtaining required strength and impact toughness.

If the fraction of the ferrite is excessive and thus the fraction of pearlite is relatively low, it is difficult to secure the strength of steel stably. On the other hand, if the fraction of pearlite is excessive, the strength and toughness of steel may be lowered.

As described above, according to an embodiment in the present disclosure, the grain size of the ferrite may be 7.5 or more in the ASTM grain size number in the ferrite and pearlite mixed structure.

If the grain size of the ferrite is less than the ASTM grain size number of 7.5, coarse grains may be mixed and the uniform toughness of the target level may not be secured.

As described above, the thick steel plate according to an embodiment in the present disclosure, which satisfies both the alloy composition and the microstructure, has impact toughness of 300 J or higher at −60° C., which may ensure excellent cryogenic impact toughness. In addition, the required strength may be secured.

The steel plate according to an embodiment may have a thickness of 5 mmt and over, in more detail, 5 to 100 mmt.

Hereinafter, a method of manufacturing a thick steel plate having excellent cryogenic toughness according to another embodiment in the present disclosure will be described in detail.

Briefly, a thick steel plate required according to an embodiment may be produced through the process of [steel slab reheating-hot rolling-cooling], and the conditions for respective steps will be described in detail below.

[Reheating]

First, a steel slab satisfying the above-described alloy composition may be prepared to then be subjected to reheating at a temperature of 1100° C. or higher.

The reheating process is performed to obtain a fine microstructure by utilizing a niobium (Nb) compound formed during the casting. The reheating process may be performed at a temperature of 1100° C. or higher to finely disperse and precipitate Nb after re-dissolution.

If the temperature at the time of reheating is less than 1100° C., dissolution may not occur properly and fine grains may not be induced, and strength may not be secured in the final steel. Further, it may be difficult to control grains by precipitates, and target properties may not be obtained.

[Hot Rolling]

The reheated steel slab may be hot-rolled according to the above-mentioned method to produce a hot-rolled steel plate.

In this case, the finishing hot rolling may be performed within a temperature range of 850 to 910° C.

In an embodiment of the present disclosure, during finishing hot rolling, the temperature is limited to an ordinary normalizing heat treatment region, to provide a thick steel plate having properties equal to or higher than that of the existing normalizing material without performing a separate normalizing heat treatment.

If the temperature is less than 850° C. during the finishing hot rolling, since the rolling is performed in a temperature region of an austenite recrystallization temperature or lower, the normalizing effect may not be obtained during rolling. On the other hand, if the temperature exceeds 910° C., grains grow and stable normalization may not be obtained.

[Cooling]

The hot-rolled steel plate produced as described above may be cooled to room temperature to prepare a final thick steel plate. In this case, as the cooling, air cooling may be performed.

According to an embodiment in the present disclosure, since the air cooling is performed in the cooling of hot rolled steel plate, a separate cooling facility is not required, which is economically advantageous. In addition, even when air cooling is carried out, all required properties may be obtained.

Hereinafter, an embodiment in the present disclosure will be described in more detail by way of examples. It should be noted, however, that the following examples are intended to illustrate the invention in more detail and not to limit the scope of the present disclosure. The scope of the present disclosure is determined by the matters set forth in the claims and the matters reasonably inferred therefrom.

MODE FOR INVENTION

Example

The slabs having the alloy compositions shown in the following Table 1 were reheated at a temperature of 1100° C. or higher and then subjected to finishing hot rolling and cooling under the conditions shown in Table 2 to prepare final steel plates.

In this case, a thick steel plate having a thickness of 20 mm and a thick steel sheet having a thickness of 30 mm were prepared for Inventive Steel 1, and a thick steel sheet having a thickness of 30 mm was prepared for Comparative Steels 1 and 2, respectively.

Subsequently, the microstructure of each thick-steel plate was observed with a microscope at a thickness of ¼t (where t is the thickness (mmt)) point, and impact properties were measured by Charpy V-notch impact test per temperature. The respective results are shown in Table 3 below.

TABLE 1

| | Alloy Composition (Wt %) | | | | | | | | | |
|---|---|---|---|---|---|---|---|---|---|---|
| Classification | C | Mn | Si | P | S | Nb | Ti | V | Ni | Cr |
| Inventive Steel 1 | 0.080 | 1.55 | 0.39 | 0.010 | 0.002 | 0.024 | 0.010 | 0.046 | 0.001 | 0.001 |
| Comparative Steel 1 | 0.159 | 1.45 | 0.39 | 0.011 | 0.003 | 0.019 | 0.001 | 0.037 | 0.002 | 0.002 |
| Comparative Steel 2 | 0.165 | 1.50 | 0.40 | 0.011 | 0.002 | 0.002 | 0.001 | 0.001 | 0.001 | 0.001 |

TABLE 2

| | Manufacturing Conditions | | |
|---|---|---|---|
| Classification | Finishing Hot Rolling | Cooling | Thickness (mmt) |
| Inventive Steel 1 | 880° C. | Air-cooling | 30 or 20 |
| Comparative Steel 1 | 880° C. | Air-cooling | 30 |
| Comparative Steel 2 | 880° C. | Air-cooling | 30 |

TABLE 3

| | Microstructure | | Impact Properties (J) | | | | | |
|---|---|---|---|---|---|---|---|---|
| Classification | Phase | F Fraction | 0° C. | −20° C. | −30° C. | −40° C. | −50° C. | −60° C. |
| Inventive Steel 1 | F + P | 88% | 400 | 402 | 395 | 399 | 398 | 398 |
| Comparative Steel 1 | F + P | 80% | 310 | 320 | 295 | 50 | 22 | 20 |
| Comparative Steel 2 | F + P | 78% | 250 | 190 | 70 | 40 | 20 | 20 |

(In Table 3, the remainder excluding the F fraction is P, where F means ferrite and P means pearlite.)

As shown in Tables 1 to 3, it can be confirmed that in Comparative Steels 1 and 2 having the same thickness (30 mmt) and containing C of not less than 0.15%, impact transitions occur in the vicinity of −40° C. and −30° C. regions, respectively. On the other hand, in the case of inventive steel 1, it can be confirmed that no impact transition occurs up to −60° C.

On the other hand, in order to confirm a change in properties due to the normalizing heat treatment, a normal normalizing heat treatment was performed for Inventive Steel 1 (thickness 20 mmt, 30 mmt) and Comparative Steel 2 (30 mmt), at 880° C. for one hour per inch thickness, and tensile properties and impact toughness (−20° C.) were measured before and after the heat treatment. The ferrite grain size was measured, and the results are shown in Table 4 below.

In this case, the tensile test was performed using a proportional piece with a total thickness of $L_0=5.65\sqrt{S_0}$ (where $L_0$ is the original gauge length and $S_0$ is the original cross-sectional area).

TABLE 4

| | Yield Strength (MPa) | | Tensile Strength (MPa) | | Impact Toughness (J) | | Grain Size | |
|---|---|---|---|---|---|---|---|---|
| Classification | Before | After | Before | After | Before | After | Before | After |
| Inventive Steel 1 (30mmt) | 408 | 395 | 492 | 492 | 399 | 397 | 8.5 | 8.5 |
| Inventive Steel 1 (20mmt) | 420 | 398 | 502 | 495 | 353 | 358 | 8.5 | 8.7 |
| Comparative Steel 2 (30mmt) | 387 | 345 | 527 | 482 | 184 | 231 | 7.2 | 7.0 |

As shown in Table 4, it can be confirmed that there is no difference in the properties of Invention Steel 1 before and after the normalizing heat treatment, regardless of the thickness.

On the other hand, in the case of Comparative Steel 2, the impact toughness after the normalizing heat treatment was improved, but the tensile strength and yield strength decreased by about 40 MPa even in the case in which the thickness was 30 mmt, and it can be confirmed that the level required in an embodiment of the present disclosure was not satisfied at all.

Then, in the case of Inventive steel 1 (30 mmt), the influence of extraction temperature on the strength at the time of reheating a slab was examined. In detail, the slabs were reheated to satisfy the respective extraction temperatures shown in Table 5, followed by finishing hot rolling at 880° C., followed by air cooling to room temperature to prepare respective thick-steel plates.

Then, the tensile properties of the above-mentioned respective steel sheets were evaluated.

TABLE 5

| Tensile Properties | 1190° C. | 1160° C. | 1150° C. | 1130° C. | 1120° C. | 1100° C. | 1090° C. |
|---|---|---|---|---|---|---|---|
| Yield Strength (MPa) | 416 | 416 | 411 | 406 | 408 | 398 | 383 |
| Tensile Strength (MPa) | 500 | 500 | 496 | 490 | 488 | 483 | 469 |

As shown in Table 5, it can be seen that as the extraction temperature decreases, strength is lowered. In detail, in the case in which the extraction temperature is 1090° C., strength is lowered about 30 MPa, as compared with the case in which the extraction temperature is 1190° C.

As the extraction temperature is lowered, the Nb re-solid solution effect, which affects microstructure refinement and the like, is reduced, which causes a decrease in strength and yield ratio under similar rolling conditions.

Therefore, the extraction temperature in reheating may be 1100° C. or higher.

The invention claimed is:

1. A thick steel plate comprising:

by weight %, 0.02 to 0.10% of carbon (C), 0.6 to 1.7% of manganese (Mn), 0.5% or less (excluding 0%) of silicon (Si), 0.02% or less of phosphorus (P), 0.015% or less of sulfur (S), 0.005 to 0.05% of niobium (Nb), 0.005 to 0.07% of vanadium (V), and a remainder of iron (Fe) and unavoidable impurities, wherein the thick steel plate has, by area fraction, a mixed structure of ferrite of 85 to 95% and pearlite of 5 to 15%, as a microstructure, a grain size of ferrite is 7.5 or more to 8.7 of ASTM grain size number, the thick steel plate has impact toughness of 300J or more at −60° C., and the thick steel plate is manufactured by a method comprising:

reheating a steel slab and finishing hot-rolling the reheated steel slab at a temperature of 880 to 910° C.

2. The thick steel plate of claim 1, wherein the thick steel plate further comprises, by weight %, at least one of not more than 0.5% of nickel (Ni) and not more than 0.5% of chromium (Cr).

3. The thick steel plate of claim 1, wherein the thick steel plate further comprises 0.005 to 0.035 weight % of titanium (Ti).

4. A method of manufacturing the thick steel plate according to claim 1, comprising:

reheating a steel slab at a temperature of 1100° C. or higher, the steel slab including, by weight %, 0.02% to 0.10 of carbon (C), 0.6 to 1.7% of manganese (Mn), 0.5% or less (excluding 0%) of silicon (Si), 0.02% or less of phosphorus (P), 0.015% or less of sulfur (S), 0.005 to 0.05% of niobium (Nb), 0.005 to 0.07% of vanadium (V), and a remainder of iron (Fe) and unavoidable impurities, finishing hot-rolling the reheated steel slab at a temperature of 880 to 910° C. to produce a hot-rolled steel plate; and air-cooling the hot-rolled steel plate to a room temperature after the finishing hot-rolling.

5. The method of claim 4, wherein the steel slab further comprises, by weight %, at least one of not more than 0.5% of nickel (Ni) and not more than 0.5% of chromium (Cr).

6. The method of claim 4, wherein the steel slab further comprises 0.005 to 0.035 weight % of titanium (Ti).

7. The thick steel plate of claim 1, comprising 0.05 to 0.10% of carbon (C).

8. The thick steel plate of claim 1, wherein the thick steel plate has a thickness of 5 to 100 mmt.

* * * * *